US005967685A

United States Patent [19]

De Laforcade

[11] Patent Number: 5,967,685

[45] Date of Patent: Oct. 19, 1999

[54] ASSEMBLY FOR APPLYING A FLUID OR A SOLID PRODUCT

[75] Inventor: Vincent De Laforcade, Rambouillet, France

[73] Assignee: L'Oreal, Paris, France

[21] Appl. No.: 08/952,519

[22] PCT Filed: Mar. 21, 1996

[86] PCT No.: PCT/FR97/00484

§ 371 Date: Jan. 16, 1998

§ 102(e) Date: Jan. 16, 1998

[87] PCT Pub. No.: WO97/34512

PCT Pub. Date: Sep. 25, 1997

[30] Foreign Application Priority Data

Mar. 21, 1996 [FR] France ..... 96/03541

[51] Int. Cl.[6] ..... A46B 5/02

[52] U.S. Cl. ..... 401/190; 401/196

[58] Field of Search ..... 401/190, 207, 401/196, 202, 205, 188, 206

[56] References Cited

U.S. PATENT DOCUMENTS

| | | | |
|---|---|---|---|
| 3,137,885 | 6/1964 | Hulsh | 401/190 |
| 3,256,549 | 6/1966 | Evesque | 401/190 |
| 3,471,245 | 10/1969 | Schwartzman | 401/207 |
| 5,567,073 | 10/1996 | De Laforcade et al. | 401/190 |
| 5,692,846 | 12/1997 | Schwarzberg | 401/190 |

FOREIGN PATENT DOCUMENTS

| | | |
|---|---|---|
| 2 647 034 | 11/1990 | France . |
| 32-15986 | 12/1957 | Japan . |
| 47-9938 | 5/1972 | Japan . |
| 3-4962 | 1/1991 | Japan . |
| 3-28954 | 6/1991 | Japan . |

*Primary Examiner*—David J. Walczak

*Attorney, Agent, or Firm*—Oblon, Spivak, McClelland, Maier & Neustadt, P.C.

[57] ABSTRACT

A product applicator assembly including a container for containing the product to be dispensed. The container includes an outlet for the product. A product applicator is in communication with the container. The applicator has an outer application surface and is borne by a support fixed onto the product outlet of the container. The support includes an elastically deformable fixing device which keeps the applicator member fixed onto the support.

25 Claims, 5 Drawing Sheets

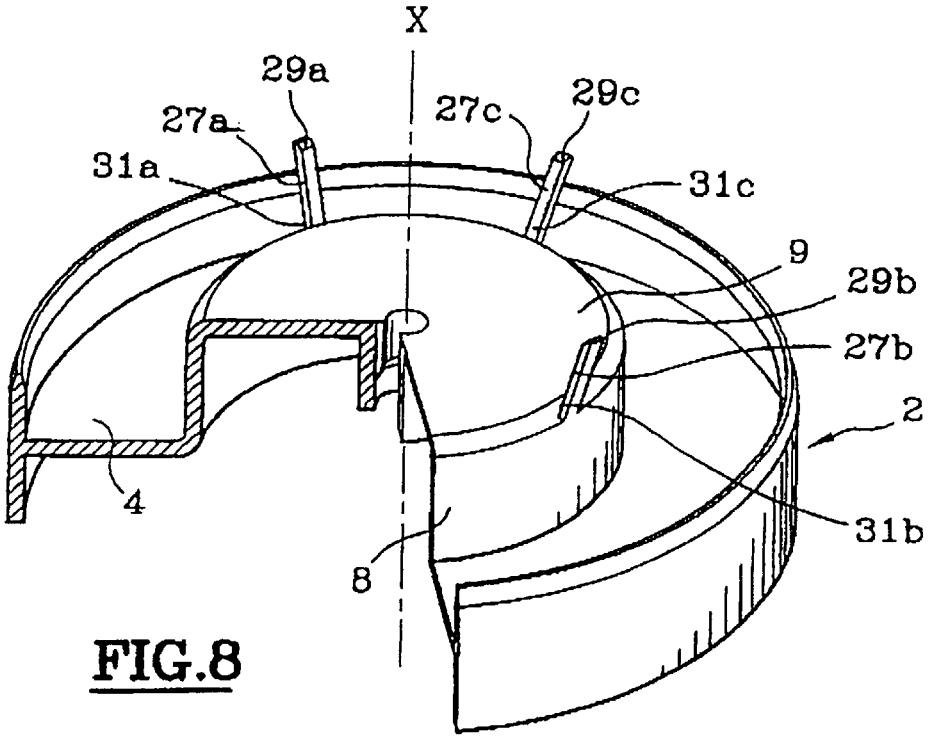
FIG.8
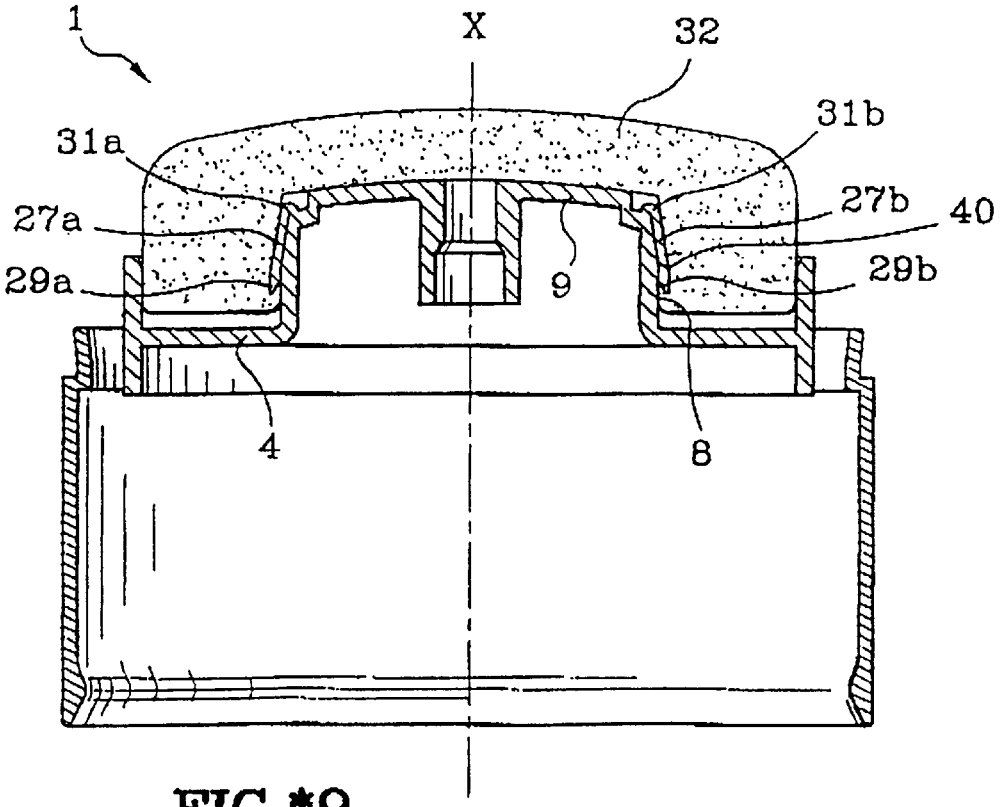
FIG.*9

ASSEMBLY FOR APPLYING A FLUID OR A SOLID PRODUCT

BACKGROUND OF THE INVENTION

1. Field of the Invention

The invention relates to an assembly for applying a fluid or a solid product to a surface to be treated. The applicator assembly may especially be used in the field of cosmetics for applying a deodorant, in the pharmaceutical field for applying insect repellants, as well as in the fields of adhesives, paints or polishes.

More specifically, this applicator assembly is intended for applying a body deodorant.

2. Discussion of the Background

Document FR-A-2,713,060 in the name of the Applicant company describes an applicator assembly comprising a pressurized product container equipped with a dispensing valve and with an applicator member including a porous dome, fixed onto the container. This dome is held on by a support connected mechanically to a collar fixed onto the container. When this assembly is applied to the surface to be treated, the porous dome becomes soaked with product. However, the product soaked into the dome may cause the volume of the dome to alter, and especially cause this volume to reduce. This variation in volume may cause the dome to be held on the support less firmly. Thus, after the applicator has been in use for a certain time, the dome may detach from the support and fall off. The applicator can therefore no longer be used and it is not possible to replace the dome on the support.

SUMMARY OF THE INVENTION

The present invention therefore aims to overcome the abovementioned drawbacks.

The principal object of the invention is to propose an applicator assembly which avoids separation of the dome from the support. Its special object is to hold the dome on the support more firmly.

The present invention therefore provides a product-applicator assembly comprising a container for the product to be dispensed, and equipped with an outlet for the product; a product-applicator member in communication with the container, having an outer application surface and borne by a support fixed onto the product outlet of the container; characterized in that the support includes elastically deformable fixing means capable of keeping the applicator member fixed onto the support.

In a first embodiment, the said elastically deformable fixing means are blocked in the position for holding the applicator member at the time the support is being fixed onto the product outlet.

Advantageously, the fixing means are elastically deformable in a direction substantially perpendicular to an axis of symmetry (X) of the container. As a preference, these fixing means exert a radial force on the applicator member.

The applicator member may advantageously include at least one catching surface into which the elastically deformable fixing means can be fixed. As a preference, the catching surface is in the form of a cylinder arranged substantially along the axis X and centred on this axis, so as to allow a uniform distribution of the fixing means fixed into the catching surface.

The elastically deformable fixing means allow the applicator member to be put back in place when it becomes detached from the support. It is also possible to change the applicator member as desired. Thus the applicator assembly according to the invention includes an interchangeable applicator member.

In a second embodiment of the invention, the elastically deformable fixing means are blocked in the position for holding the applicator member before the support is fixed onto the product outlet.

Advantageously, the applicator assembly comprises a skirt bearing radially against the fixing means, allowing these to be firmly blocked in the holding position.

Furthermore, to ensure that the applicator member is fixed firmly, the support may comprise a wall equipped with an internal surface and with an external surface of a shape which complements the catching surface of the applicator member and including the elastically deformable fixing means.

As elastically deformable fixing means, use may be made of flexible tabs equipped with catching means, the shape of which may easily be moulded at the time the support is being manufactured. For example, the catching means may comprise at least one barb. They could be a simple hook or a radially projecting element, especially a protuberance.

In the first embodiment, the elastically deformable fixing means can be blocked in the holding position using a component placed between the support and the container. This component may comprise a skirt having an external surface which complements the internal surface of the wall of the support and bears radially against the said internal surface of the wall. The fact that the skirt bears radially prevents deformation of the elastically deformable fixing means while the support is being fixed onto the product outlet.

In particular, when the fixing means are elastically deformable in a direction substantially perpendicular to the axis X, the component prevents any deformation of these fixing means in this perpendicular direction.

In this embodiment, the elastically deformable fixing means are blocked in the holding position before the support is fixed onto the product outlet of the container.

Advantageously, the component may include a first skirt and a second skirt which may be in the form of coaxial cylinders arranged substantially along the axis X and centred on this axis. In particular, the first skirt may be fixed, especially by a tight push-fit, onto an adapter of the support, the adapter being fixed onto the product outlet of the container. The second skirt preferably has an external surface which complements the internal surface of the wall of the support, which means that the fixing means are blocked firmly in the holding position.

In a third embodiment according to the invention, the elastically deformable fixing means are blocked in the position for holding the applicator member at the time the support is being fixed onto the product outlet.

In this second embodiment, the support includes a deformable adapter connected to the elastically deformable fixing means by a deformable connecting means, the assembly formed by the adapter, the connecting means and the fixing means being blocked in the holding position at the time the adapter is being fixed onto the product outlet of the container.

Advantageously, the deformable connecting means is in the form of a strip. This strip preferably lies in a plane substantially perpendicular to the axis X, so as to interact with the elasticity of the fixing means in a direction substantially perpendicular to the axis X.

Thus, when the adapter is fixed onto the product outlet, it deforms in a direction substantially perpendicular to the axis X, and this deformation is transmitted via the deformable connecting means, for example the said strip, to the fixing means and these are then held in the holding position.

Moreover, the applicator assembly may comprise deformable links between the support and a collar fixed to the container, which makes the assembly easy for the user to handle and gives operating flexibility. These deformable links may consist of one or more flexible thin strips distributed uniformly between the support and the collar.

In a fourth embodiment of the invention, the elastically deformable fixing means may be bendable tabs. When the applicator member is placed on the support, the tabs bend and become fixed into the catching surface of the applicator member. In this embodiment, the elastically deformable fixing means are blocked in the position for holding the applicator member at the time the applicator member is being fixed onto the support, independently of the fixing of the support onto the product outlet.

Furthermore, the container of the assembly according to the invention may comprise means of compressing the product which are capable of producing sufficient pressure on the product to push it through the applicator member. However, the container could be a bottle or a flexible tube actuated manually.

Advantageously, the applicator member may be made of a rigid or deformable material. For example, the applicator member may be an open-cell foam, a sponge, or better still a sinter. As a preference, the applicator member has the shape of a dome with a substantially convex or flat application surface.

The applicator assembly is entirely suitable for dispensing a body deodorant. Thus another subject of the present invention is an assembly for applying body deodorant consisting of an applicator assembly as defined earlier.

BRIEF DESCRIPTION OF THE DRAWINGS

Apart from the provisions set out hereinabove, the invention consists in a certain number of other provisions which will be explained hereinafter, with regard to embodiments described with reference to the appended figures, but which are not in any way limiting.

FIGS. 1 to 3 illustrate a first embodiment of an applicator assembly according to the invention, in which:

FIG. 1 is an axial section through a support equipped with an applicator member, before it is fixed onto a container;

FIG. 2 is a perspective view, with partial section, of the support of FIG. 1; and FIG. 3 is an axial section through an applicator assembly including the support of FIG. 2 after it has been fixed onto the container;

FIGS. 4 to 6 illustrate a second embodiment of an applicator assembly according to the invention, in which:

FIG. 4 is a perspective view, with partial section, of a support;

FIG. 5 is an axial section through the support of FIG. 4 equipped with an applicator member before it is fixed onto a container; and FIG. 6 is an axial section through an applicator assembly including the support of FIG. 4 after it has been fixed onto the container;

FIGS. 8 and 9 illustrate a fourth embodiment of an applicator assembly according to the invention, in which:

FIG. 8 is a perspective view, with partial section, of a support; and

FIG. 9 is an axial section through the support equipped with an applicator member.

DISCUSSION OF THE PROFFERED EMBODIMENTS

Figure 1:
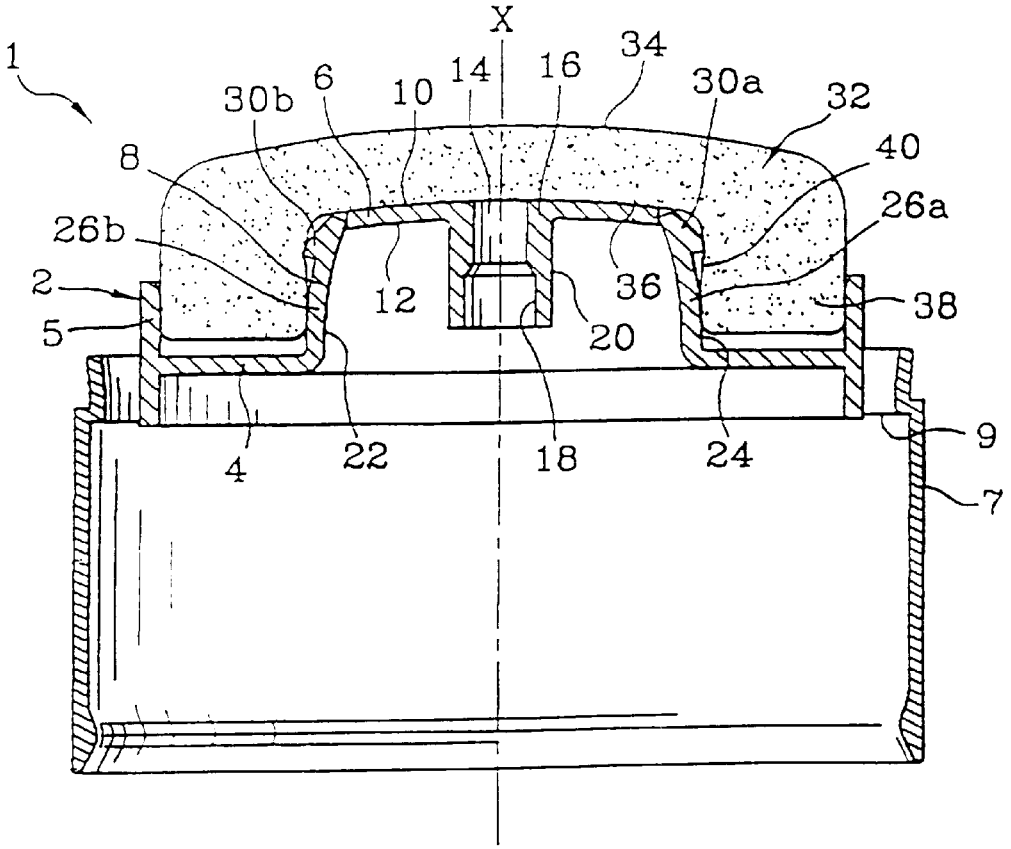
Figure 2:
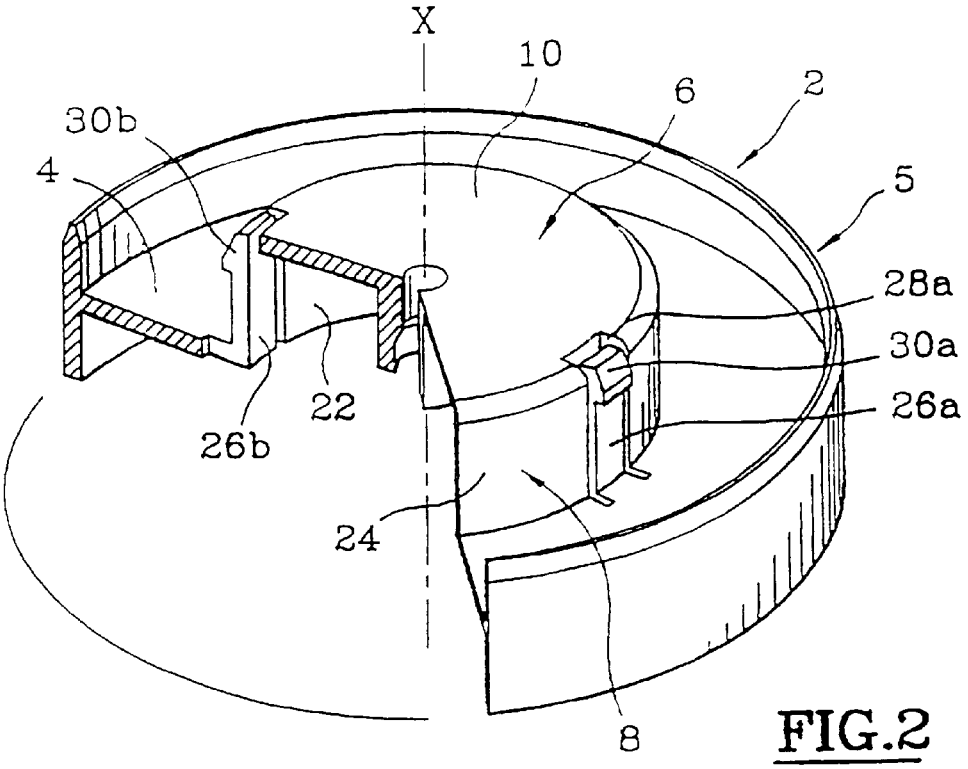
Figure 3:
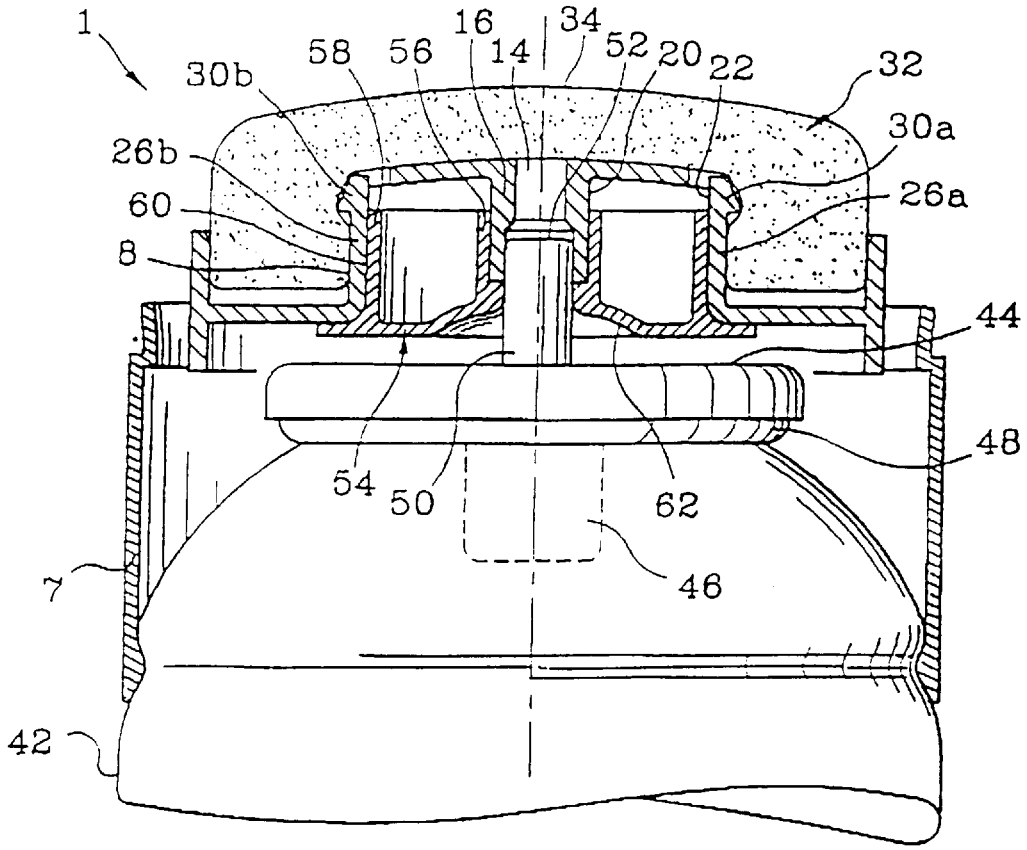

Referring to the appended FIGS. 1 to 3, it is possible to see a support 2 bearing an applicator member 32. The support 2 is equipped with an annular groove 4 delimited by a peripheral ring 5 and with a coaxial wall 8. This support 2 also includes a plate 6 borne by the wall 8. This wall 8 is in the form of a cylinder centred on an axis X. The plate 6 includes an upper face 10 and a lower face 12, as well as an orifice 14 centered on the axis X. This plate 6 is equipped on its lower face 12 with a central hollow adapter 16 comprising an internal envelope 18 and an external envelope 20.

The wall 8 includes an internal surface 22 and an external surface 24. As better visible in FIG. 2, the wall 8 also includes tabs 26*a*, 26*b* situated in longitudinal apertures 28*a*, 28*b* made in the wall 8. Each tab 26*a*, 26*b* is elastically deformable in a direction perpendicular to the axis X and on the same side as the external surface 24 of the wall 8 has a protuberance 30*a*, 30*b* in the form of a barb. Two tabs arranged on a diameter can be seen in FIGS. 1 to 3.

The support 2 is attached by its peripheral ring 5 to a cylindrical collar 7 intended to be fixed onto a container 42 (FIG. 3), the connection being by means of a link, such as flexible deformable thin strips 9. This connection allows the applicator member 32 to be actuated flexibly and gives the user a feeling of comfort.

The applicator member 32 is a porous dome made of a sintered material equipped with a slightly domed outwardly convex upper application surface 34 and a lower surface 36 in contact with the upper face 10 of the plate 6. The dome 32 also includes an annular part 38 secured to the application surface 34 and housed in the annular groove 4 of the support 2 and has an internal catching surface 40 in the form of a cylinder centred on the axis X. It can be seen from FIG. 1 that the catching surface 40 has a shape which complements that of the external surface 24 of the wall 8 and closely follows the shape of this external surface 24.

When the dome 32 is housed in the annular groove 4, the catching surface 40 pushes the tabs 26*a*, 26*b* radially in a direction substantially perpendicular to the axis X and directed towards this axis.

Referring to FIG. 3, it is possible to see an applicator assembly denoted overall by the reference 1, symmetric about the axis X and including a container 42, which is generally cylindrical and pressurized using a propellent gas. At its upper end, this container 42 bears a dished element 44 for a valve 46 which element is fixed to the container by a crimped roll 48. The dished element 44 for the valve bears, along the axis X, the dispensing valve 46 which, in this example, is a male valve including an emerging hollow stem 50. This valve is a valve which deforms laterally, also known as a tilt valve, which is opened by tilting the stem 50 laterally, or a valve which is pushed down axially. The container also contains a liquid or pasty product to be dispensed, for example a cosmetic product such as a deodorant, scent, depilatory or thinning product. Furthermore, the end 52 of the hollow stem 50 acts as an outlet for the product contained in the container 42. Quite obviously, the pressurized container 42 could be replaced by a flexible tube actuated manually.

Before fixing the support of FIG. 1 onto the container 42, a component 54 of cylindrical shape is placed between the support 2 and the container 42. This component 54 has a first, internal, skirt 56 and a second skirt 58 equipped with an external surface 60, these skirts 56 and 58 being coaxial and connected to a disc-shaped base 62 lying in a plane substantially perpendicular to the axis X. The external surface 60 has a cylindrical shape centred on the axis X, complementing the internal surface 22 of the wall 8 and bears against the surface 22.

The component 54 is fixed to the support 2 by a tight push-fit over the external envelope 20 of the adapter 16. The external surface 60 of the second skirt 58 is therefore in contact with the internal surface 22 of the wall 8 and prevents any deformation of the tabs 26*a*, 26*b*. The barbs 30*a*, 30*b* of these tabs are pushed into the catching surface 40 of the porous dome 32 holding the latter fixed in position in the support 2.

After the component 54 has been fixed onto the support 2, the collar 7 is then fixed onto the container 42 and the free end 52 of the valve stem 50 is engaged forcibly in the adapter 16 of the support 2. Of course the support 2 could be fixed directly onto the valve stem 50 without the collar.

To use the applicator assembly of the invention, the user exerts a pressure or pushes on the upper application surface 34 of the porous dome 32. The porous dome 32 tilts or is pushed in (depending on the type of valve used) and by tilting or pushing in the stem 50 of the valve 46 causes the valve to open. The product passes through the orifice 14 of the support 2 then diffuses into the porous dome 32 and spreads out over its upper surface 34. The product is thus applied to the surface to be treated.

The dome 32 held by the fixing means of the invention remains firmly fixed into the support 2 despite variations in volume of the dome which may a rise during use of the applicator assembly.

Figure 4:
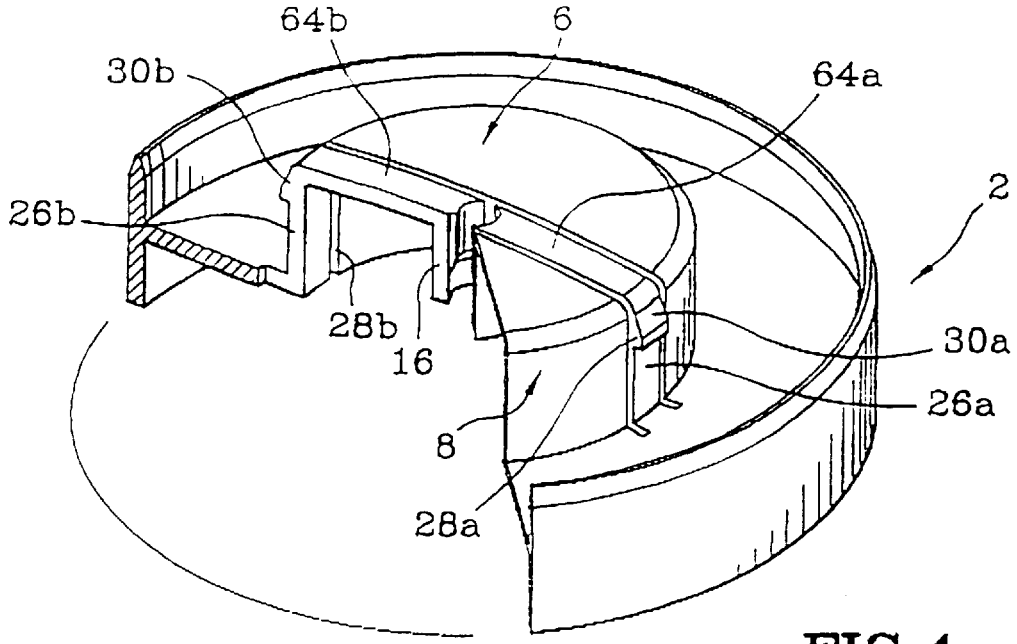
Figure 5:
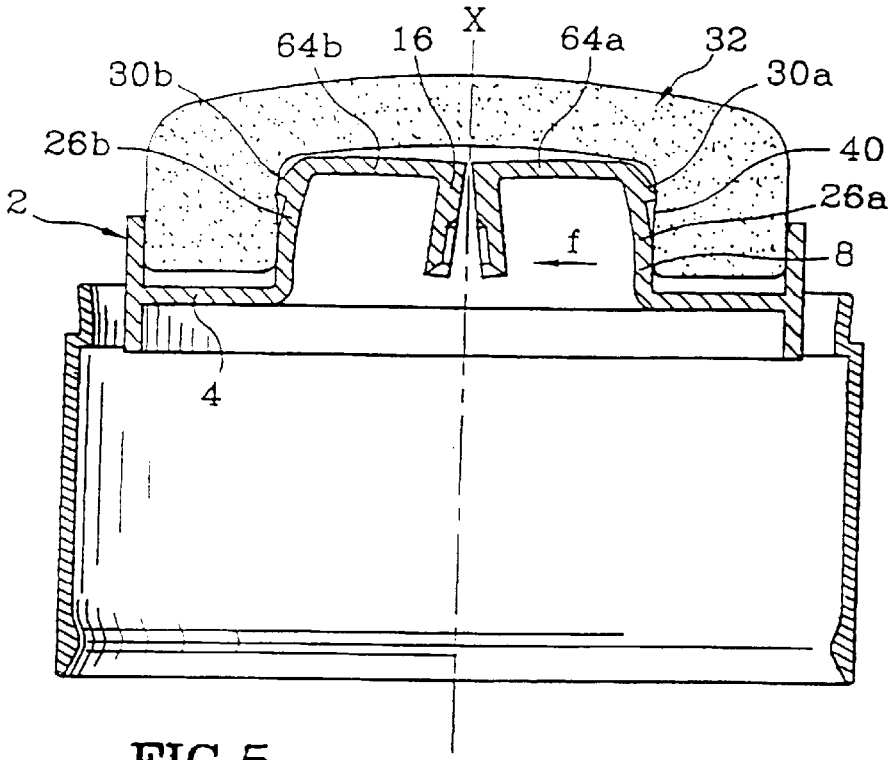
Figure 6:
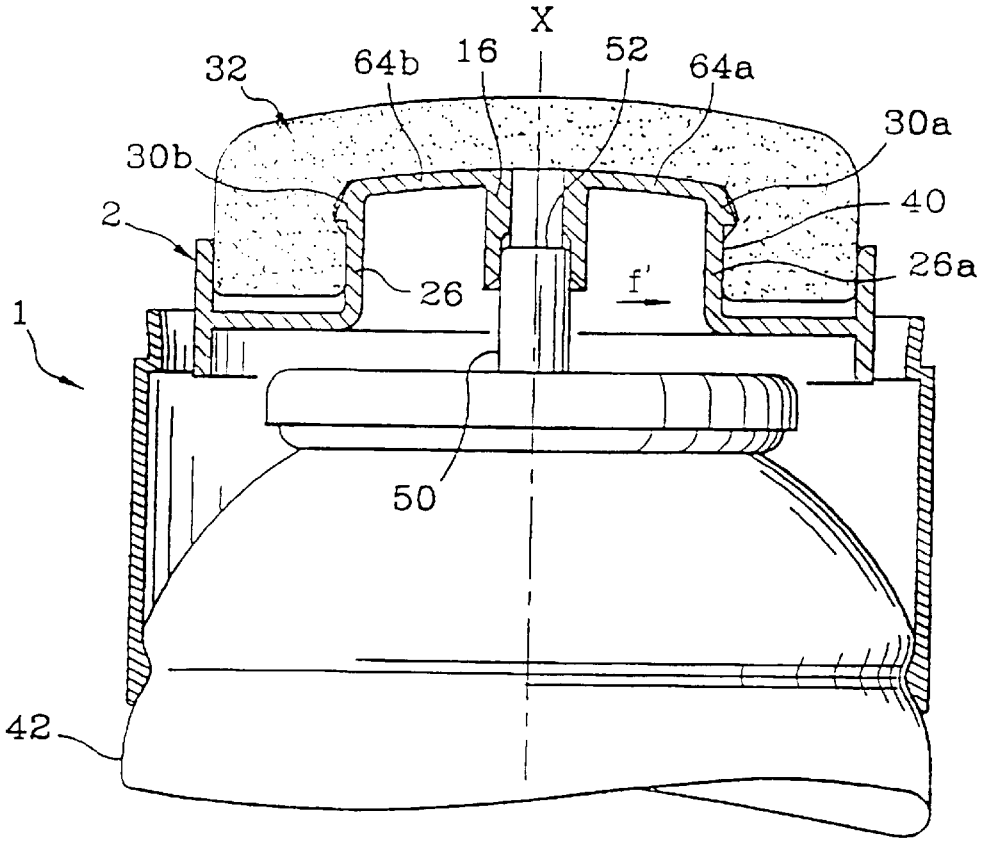

In FIGS. 4 to 6, elements which are identical or fulfil comparable roles to the elements already described are denoted by the same numerical references. They will not be described again, or will be described just briefly.

FIGS. 4 to 6 show a support 2 which can be distinguished from that of FIG. 2 by the fact that the tabs 26*a*, 26*b* are held in the position for holding the dome 32 by fixing the adapter 16 onto the free end 52 of the valve stem 50.

In this embodiment, the adapter 16 is elastically deformable in a direction perpendicular to the axis X and is connected to the upper end of each tab 26*a*, 26*b* by an elastically deformable strip 64*a*, 64*b*. The strip is cut from the plate 6 of the support, in line with the apertures 28*a*, 28*b* in the wall 8.

When the dome 32 is placed in the annular groove 4 of the support 2, as visible in FIG. 5, the catching surface 40 of the dome 32 bears against the protuberances 30*a*, 30*b* and pushes the tabs 26*a*, 26*b* back towards the axis X (arrow f). This movement of the tabs 26*a*, 26*b* causes the strips 64*a*, 64*b* to move in the same direction, thus causing deformation (compression) of the adapter 16.

When the free end 52 of the valve stem 50 is engaged forcibly in the adapter 16, as shown in FIG. 6, this adapter is deformed in a direction substantially perpendicular to and away from the axis X (arrow f'). This deformation of the adapter 16 also causes a deformation of the strips 64*a*, 64*b*, leading to the radial movement of the tabs 26*a*, 26*b*. The barbs 30*a*, 30*b* of these tabs are then pushed into the catching surface 40 of the porous dome 32. As the adapter 16 is now fixed permanently to the free end 52 of the valve stem 50, the strips 64*a*, 64*b* and the tabs 26*a*, 26*b* can no longer deform and the dome 32 is held fixed in position in the support 2.

Figure 7:
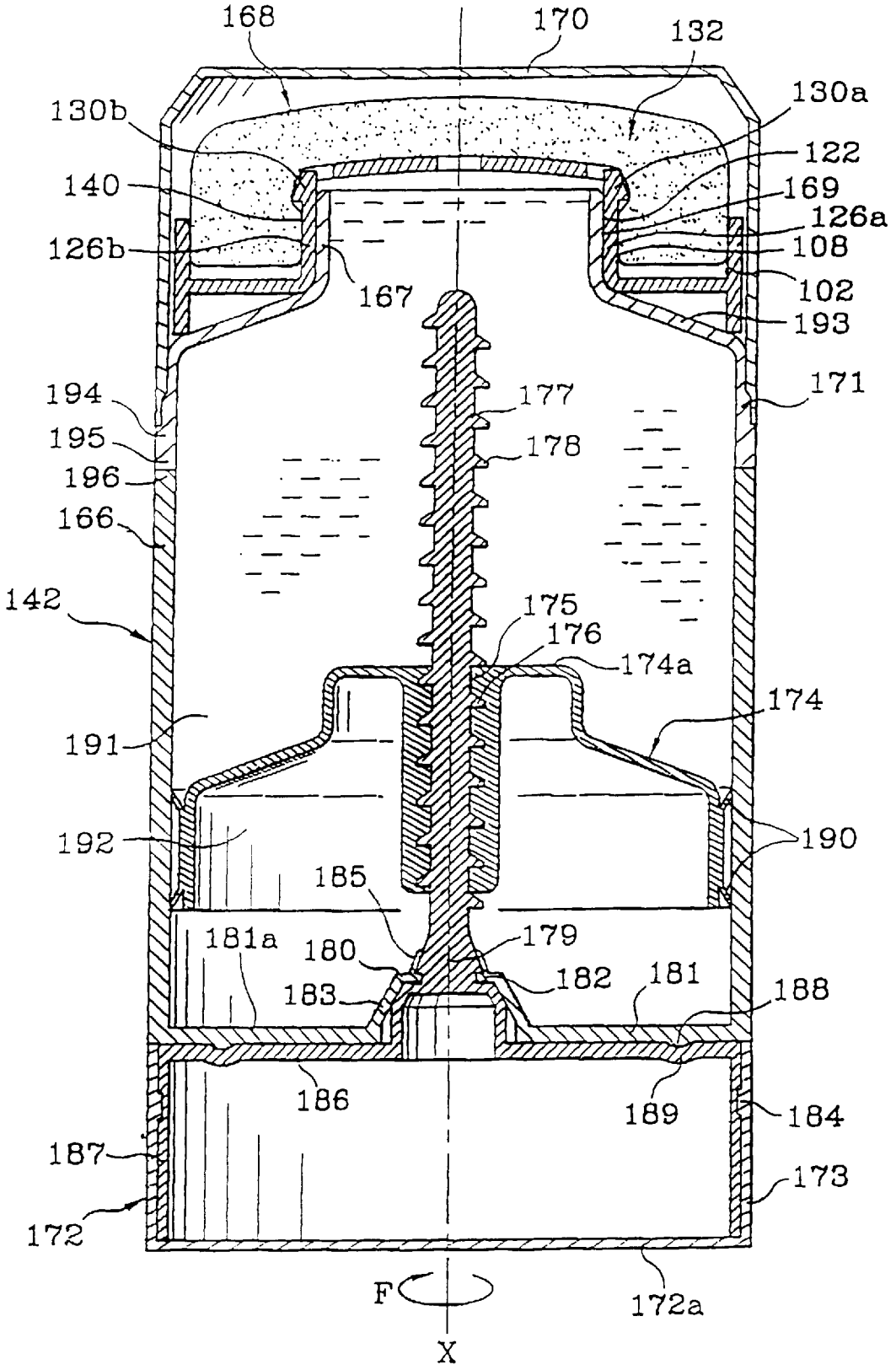
FIG. 7 is an axial section through an applicator assembly in accordance with a third alternative form of the invention.

Represented in FIG. 7 is an alternative form of the invention; the elements which are identical or fulfil comparable roles to elements already described with regard to the preceding figures are denoted by the same references increased by 100. They will not be described again or will be described only briefly. The differences relate to the means of compressing the product, which are of a mechanical nature.

Thus the container 142 comprises a cylindrical body 166 having a longitudinal axis X and containing the product which is preferably of a thick consistency, such as a deodorant gel. The cross section of the body 166 perpendicular to the axis X may be circular or oval. The cylindrical body 166 at one of its ends has a neck 167 equipped with a dispensing head 168. This head 168 comprises a porous dome 132 borne by a support 102 as illustrated in FIG. 2. The dome 132 is in communication with the product outlet of the container 142, that is to say with the end of the neck 167 bearing the dispensing head 168.

The neck 167 has an external surface 169 of cylindrical shape centred on the axis X and complementing the internal surface 122 of the wall 108 of the support 102. The neck 167 is connected to a skirt 194 by a cylindrical shoulder 193, the lower end 195 of the skirt 194 being fixed to the upper edge 196 of the body 166. When the support 102 is tightly push-fitted over the neck 167 of the container 142, the external surface 169 of the neck 167 then bears against the internal surface 122 of the wall 108 and prevents any deformation of the tabs 126*a*, 126*b*. The barbs 130*a*, 130*b* of these tabs are pushed into the catching surface 140 of the porous dome 132, holding the latter fixed in position in the support 102.

The dispensing head 168 is covered by a cap 170 which is fixed onto an annular rim 171 of the skirt 194.

The second end of the body 166, the opposite end to the dispensing head 168, includes an actuating element 172 in the form of an elongate knob with the same cross section as that of the body 166, this knob being mounted so that it can pivot about the axis X of the assembly.

The side wall 173 of the actuating element 172 acts as a surface for gripping which is accessible around the entire periphery of the element 172. A user may thus grasp the element 172 and twist it about the axis X as symbolized in FIG. 7 by the arrow F.

Furthermore, on the inside the body 166 includes a piston 174, the cross section of which corresponds exactly to the internal cross section of the body 166. This piston 174 at its centre has an orifice 175 which is tapped 173 and through which there passes a stem 177 equipped with a screw thread 178 and with a frustoconical base 179 equipped with an annular groove 182. This stem 177 is mounted so that it can rotate freely about the axis X of the assembly, while being axially immobilized. For this purpose, the bottom 181 of the body includes a projecting annular rim 180 which interacts with the annular groove 182 of the frustoconical base 179 and made in a skirt 183 secured to the bottom 181, the skirt 183 pointing towards the container. The skirt 183 has a shape suited to taking the frustoconical base 179 of the stem 177 and ensures that the stem 177 is held axially.

The rim 180 is surrounded with an elastic sleeve 185 to seal the inside of the container 142 against the outside, thus preventing any ingress of ambient air which could lead to the packaged product drying out or becoming degraded.

The base 179 of the stem 177 is secured to the actuating element 172. In effect, this base is connected to a plate 186 extended laterally by a cylindrical skirt 187 which is connected to the side wall 173 of the actuating element 172 by a groove/shoulder system 184. The opposite end of the element 172 to the base 179 is closed by a plate 172*a*.

The flat part 181*a* of the bottom 181 and the plate 186 are provided with boss 188/hollow part 189 systems arranged facing each other and interacting with each other, this system allowing the user to reposition the actuating element 172 in line with the body 166.

Furthermore, the piston 174 has an upper face 174*a* in contact with the product to be dispensed and the shape of which complements that of the shoulder 193 of the container. The piston 174 also includes sealing lips 190 at its periphery and these bear very firmly against the internal side wall of the body 166 and provide a perfect seal between the volume 191 of the container containing the product to be dispensed and the volume 192 defined between the piston 174 and the bottom 181.

To use the applicator assembly, the user removes the cap 170 from the container then twists the actuating element 172 in the direction of the arrow F. The rotation of this element 172 causes the stem 177 to rotate and makes the piston 174 move axially, which has the effect of pushing the product through the dome 132. The product can therefore be applied to the surface to be treated.

FIGS. 8 and 9 represent an alternative form according to the invention. The differences relate to the elastically deformable fixing means.

Referring to FIG. 8, it may be seen that the upper end 9 of the wall 8 includes tabs 27*a*, 27*b*, 27*c* in the form of rods, the axis of which is slightly inclined with respect to the axis X of the support. Each tab 27*a*, 27*b*, 27*c* comprises a free end 29*a*, 29*b*, 29*c*, the second end 31*a*, 31*b*, 31*c* of each tab being fixed to the support 2.

When the dome 32 is housed in the annular groove 4, the catching surface 40 pushes the tabs 27*a*, 27*b*, 27*c* towards the annular groove 4. As visible in FIG. 9, the tabs 27*a*, 27*b* are therefore bent and arranged between the wall 8 and the catching surface 40. As the tabs 27*a*, 27*b* are elastically deformable, they exert a radial force on the catching surface 40 and thus hold the applicator member 32 on the support 2. In addition, the free end 29*a*, 29*b* penetrates the catching surface 40. If the applicator member has a tendency to become detached from the support, the tabs 27*a*, 27*b* brace themselves and therefore prevent the applicator member 32 from separating from the support 2. The dome 32 can be held on the support even more firmly still if the free ends 29*a*, 29*b* of the tabs 27*a*, 27*b* are shaped to a point. These pointed ends 29*a*, 29*b* will then penetrate the catching surface 40 of the dome 32 more readily, allowing this dome to be held on the support 2 even more reliably.

I claim:

1. A product applicator assembly comprising:

a container adapted to contain a product to be dispensed and equipped with an outlet for discharging the product; and a product-applicator member comprising a compressible material in communication with the container, said product-applicator member having an outer application surface, said product-applicator member being borne by a support fixed onto the outlet of the container;

wherein said support includes elastically deformable fixing means capable of engaging with the compressible material of the applicator member to keep the applicator member fixed into the support.

2. Applicator assembly according to claim 1, characterized in that the fixing means are elastically deformable in a direction substantially perpendicular to an axis of symmetry of the applicator member.

3. Applicator assembly according to claim 1, characterized in that the applicator member includes at least one catching surface into which the elastically deformable fixing means can be fixed.

4. Applicator assembly according to claim 3, characterized in that the support comprises a wall equipped with an external surface and with an internal surface, the external surface complementing the catching surface of the applicator member and including the elastically deformable fixing means.

5. Applicator assembly according to claim 3, characterized in that the catching surface is in the form of a cylinder centered on an axis of symmetry of the applicator member.

6. Applicator assembly according to claim 1, characterized in that the elastically deformable fixing means are flexible tabs equipped with catching means.

7. Applicator assembly according to claim 6, characterized in that the catching means comprise at least one barb.

8. Applicator assembly according to claim 1, characterized in that the elastically deformable fixing means are blocked in a holding position at least one of before and when the support is being fixed onto the product outlet of the container.

9. Applicator assembly according to claim 1, characterized in that the elastically deformable fixing means are blocked using a component placed between the support and the container.

10. Applicator assembly according to claim 9, characterized in that the component comprises a skirt having an external surface which complements an internal surface of a wall of the support and bears radially against said internal surface.

11. Applicator assembly according to claim 9, characterized in that the component includes a first skirt and a second skirt, the first skirt being fixed onto an adapter of the support, the adapter being fixed onto the product outlet of the container, and the second skirt having an external surface which complements an internal surface of the wall of the support.

12. Applicator assembly according to claim 9, characterized in that the component is a neck of the container and that the elastically deformable fixing means are blocked by the neck.

13. Applicator assembly according to claim 1, characterized in that the support includes a deformable adapter connected to the elastically deformable fixing means by a deformable connecting means, the assembly formed by the adapter, the connecting means and the fixing means being blocked in position at the time the adapter is being fixed onto the product outlet of the container.

14. Applicator assembly according to claim 13, characterized in that the deformable connecting means is in the form of a strip.

15. Applicator assembly according to claim 14, characterized in that the strip lies in a plane substantially perpendicular to the axis of symmetry of the applicator member.

16. Applicator assembly according to claim 1, characterized in that the elastically deformable fixing means are bendable tabs.

17. Applicator assembly according to claim 16, characterized in that the tabs are bent when the applicator member is fixed onto the support and hold the applicator member on the support.

18. Applicator assembly according to claim 1, further comprising one deformable link between the applicator member and a collar fixed onto the container.

19. Applicator member according to claim 1, further comprising means for compressing the product which are capable of producing sufficient pressure on the product to push it through the applicator member.

20. Applicator assembly according to claim 19, characterized in that the compression means include a piston associated with a means of operating the piston.

21. Applicator assembly according to claim 20, characterized in that the operating means comprise a stem equipped with a screw thread secured to an actuating element, the screw thread of the stem interacting with a complementary screw thread of the piston.

22. Applicator assembly according to claim 19, characterized in that the compression means include a propellent gas and a dispensing valve equipped with a hollow stem interacting with the applicator member.

23. Applicator assembly according to claim 1, characterized in that the applicator member is made from a sintered material.

24. Applicator assembly according to claim 1, characterized in that the applicator member is a porous dome.

25. An applicator assembly according to claim 1, characterized in that the applicator assembly applies a body deodorant.

* * * * *

UNITED STATES PATENT AND TRADEMARK OFFICE

CERTIFICATE OF CORRECTION

PATENT NO. : 5,967,685

DATED : October 19, 1999

INVENTOR(S): Vincent DE LAFORCADE

It is certified that an error appears in the above-identified patent and that said Letters Patent is hereby corrected as shown below:

On the title page, item [22] is incorrect, should be:

-- [22] PCT Filed: Mar. 19, 1997 --

Signed and Sealed this

First Day of August, 2000

*Attest:*

Q. TODD DICKINSON

*Attesting Officer*

*Director of Patents and Trademarks*